US007390227B2

(12) United States Patent
Hsu et al.

(10) Patent No.: US 7,390,227 B2
(45) Date of Patent: Jun. 24, 2008

(54) CONNECTION MODULE

(75) Inventors: Han-Cheng Hsu, Taoyuan Hsien (TW); Chen-Jung Chen, Taoyuan Hsien (TW); Ching-Man Kao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/369,873

(22) Filed: Mar. 8, 2006

(65) Prior Publication Data

US 2007/0049126 A1 Mar. 1, 2007

(30) Foreign Application Priority Data

Aug. 24, 2005 (TW) ..... 94128838 A

(51) Int. Cl.
*H01R 23/02* (2006.01)

(52) U.S. Cl. ..... 439/676; 439/382

(58) Field of Classification Search ..... 439/676, 439/382, 383–385, 352
See application file for complete search history.

(56) References Cited

U.S. PATENT DOCUMENTS 5,312,273 A * 5/1994 Andre et al. ..... 439/607
6,257,935 B1 * 7/2001 Zhang et al. ..... 439/680
6,322,397 B1 11/2001 Zhang et al.
6,702,622 B2 * 3/2004 Sato et al. ..... 439/676
6,808,427 B1 * 10/2004 Xue ..... 439/676
6,935,900 B2 * 8/2005 Wan et al. ..... 439/677
6,966,798 B1 * 11/2005 Wu ..... 439/677
7,108,563 B2 * 9/2006 Sato et al. ..... 439/676
2001/0004567 A1 * 6/2001 Chen et al. ..... 439/607

FOREIGN PATENT DOCUMENTS

EP 0 527 332 2/1993

* cited by examiner

*Primary Examiner*—Gary F. Paumen
(74) *Attorney, Agent, or Firm*—Birch, Stewart, Kolasch & Birch, LLP

(57) ABSTRACT

A connection module for connecting an external plug includes a body, a plurality of internal terminals and a holding device. The holding device is disposed in the body and includes a plate, a first support and a second support. When the external plug is fitted in the connection module, the external plug can be securely fixed in the corresponding connection module.

17 Claims, 5 Drawing Sheets

CONNECTION MODULE

BACKGROUND OF THE INVENTION

1. Field of the Invention

The invention relates to a connection module, and in particular to a connection module for receiving an external plug.

2. Description of the Related Art

With the evolution of CPUs and popularization of internet, high performance and efficient data calculation can be obtained; thus, different kinds of information services can be provided.

Connectors and hubs are usually used for connecting electronic devices, e.g., a PC or a notebook, to the internet. For example, an RJ-45 jack and an RJ-45 plug are popular and useful elements coupled each other to transmit signals from a PC to the internet. Traditionally, the size of an opening of the jack is generally larger than that of the plug to facilitate the coupling between the jack and the plug. However, this kind of connection way would easily cause the plug to shake in the jack, due to the larger opening of the jack, which will decrease the stability of signal transmission, increase the impedance between the jack and the plug, and thus, slow the signal transmission speed.

SUMMARY OF THE INVENTION

The invention provides a connection module for connecting an external plug. The connection module comprises a body, a plurality of internal terminals and a holding device. The body comprises an opening and a hole, wherein the opening receives the external plug corresponding to the body. The internal terminals are disposed in the body and electrically coupled to external terminals of the external plug. The holding device is also disposed in the body and comprises at least one protrusion used to press against the external plug when the external plug is fitted in the opening of the body.

The holding device comprises a plate, a first support passing through the hole and a second support passing through the hole. The juxtaposed first and second supports are respectively disposed, in parallel, at opposite ends of the plate.

The first and second supports respectively comprise at least one slanted surface and one extended portion. The extended portions of the first and second supports abut against a sidewall of the hole to reinforce the structure of the first and second supports. The slanted surfaces of the first and second supports are used for guiding the external plug to a correct position in the body.

The invention provides high structural stability, high quality signal transmission and low interference between pairs of the connection module and the external plug. Besides RJ-45 connectors, the conception of the invention can also apply to any kinds of connection modules for computers or other communication equipment.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE PREFERRED EMBODIMENTS

Figure 1A:
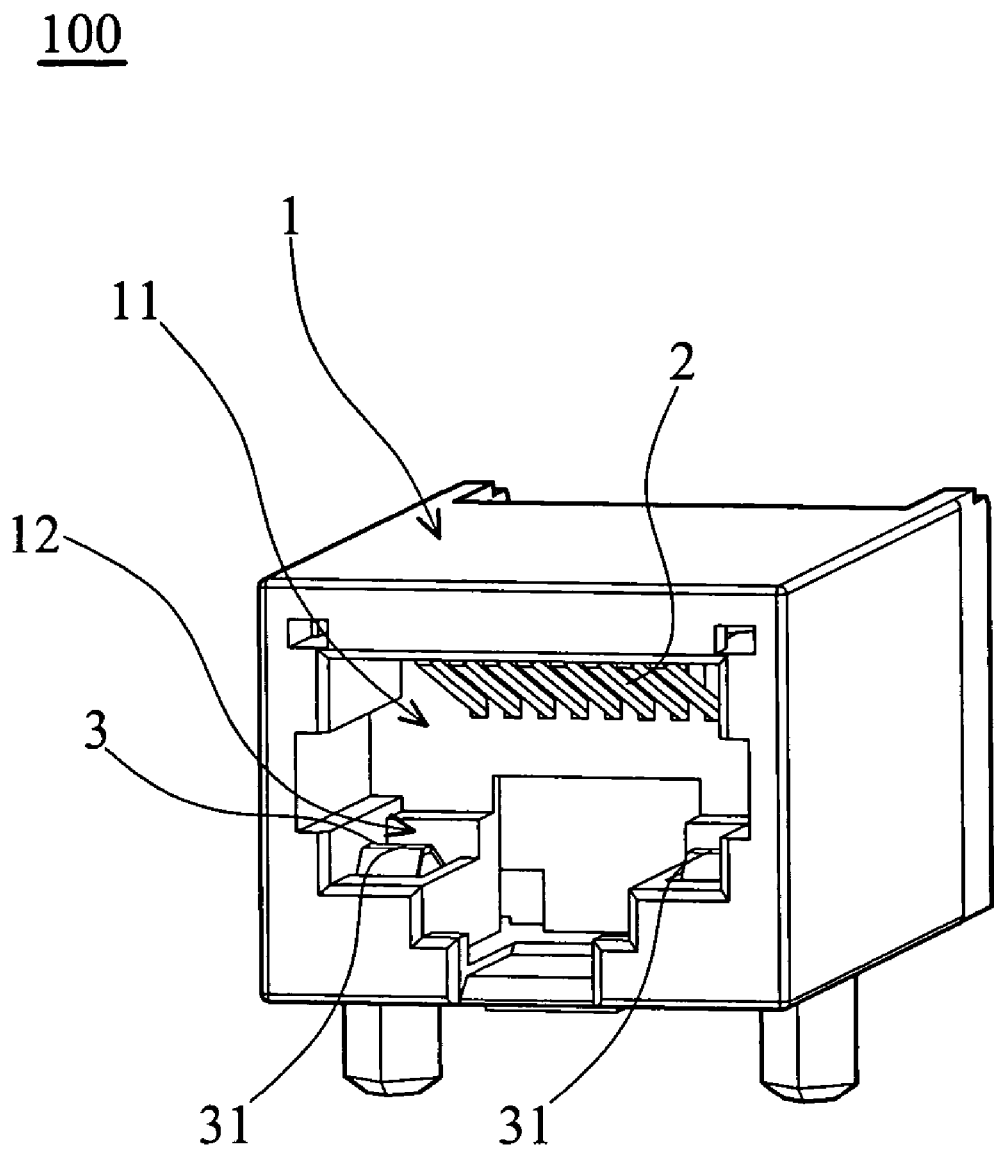
FIG. 1A is a schematic view of a connection module of an embodiment of the invention.
Figure 1C:
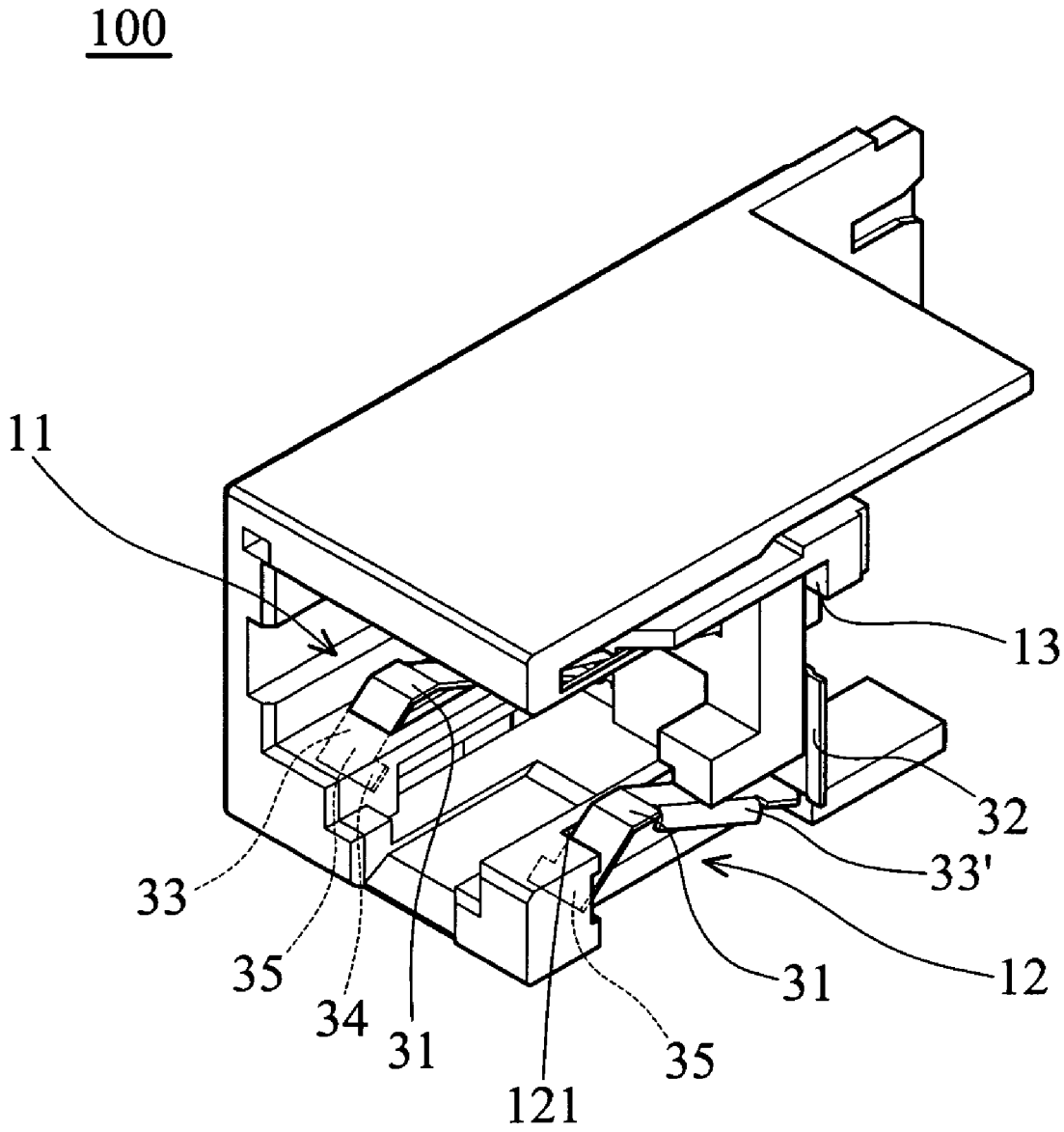
FIG. 1C is a sectional view of the connection module of FIG. 1A.
Figure 2A:
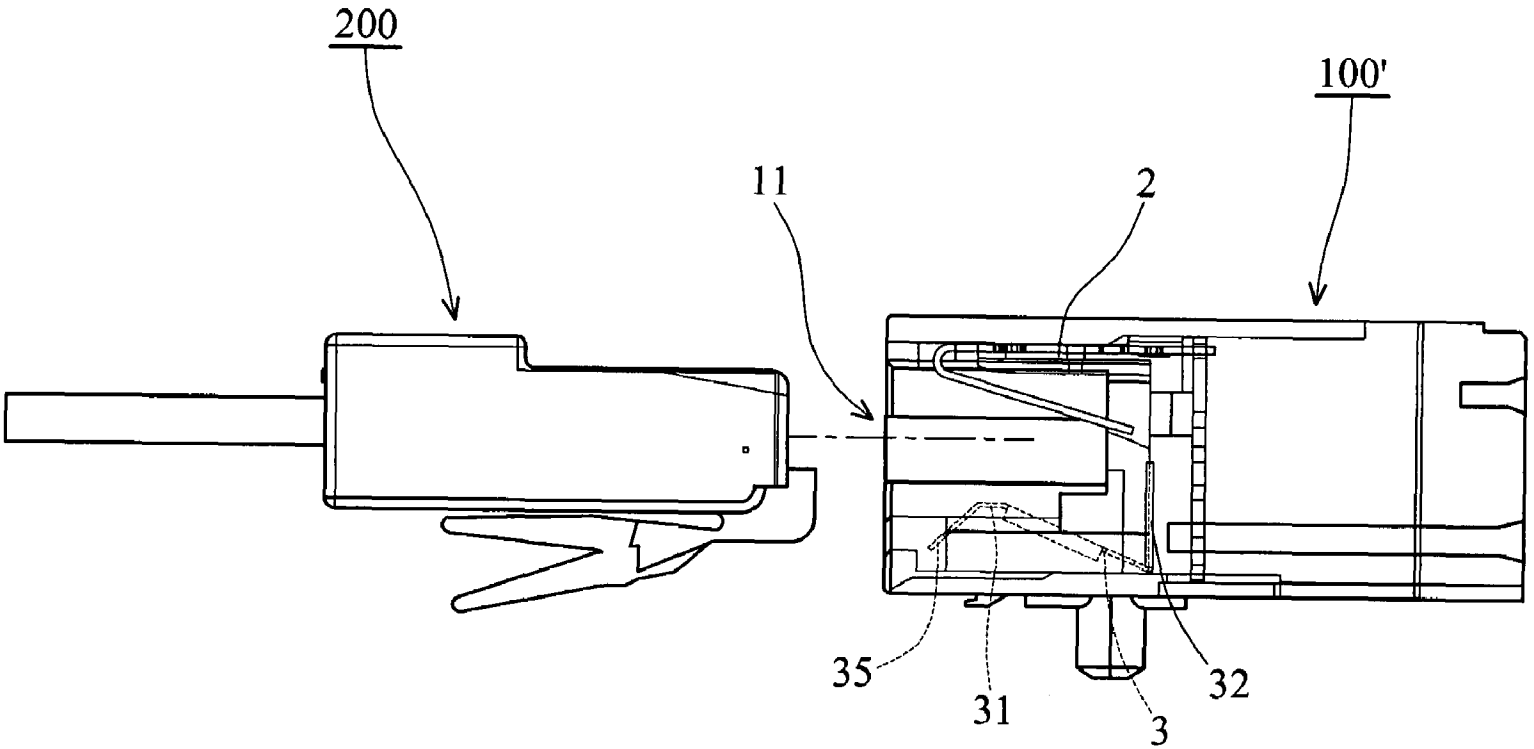
FIG. 2A is a schematic view of the connection module of another embodiment of the invention in relation to an external plug.
Figure 2B:
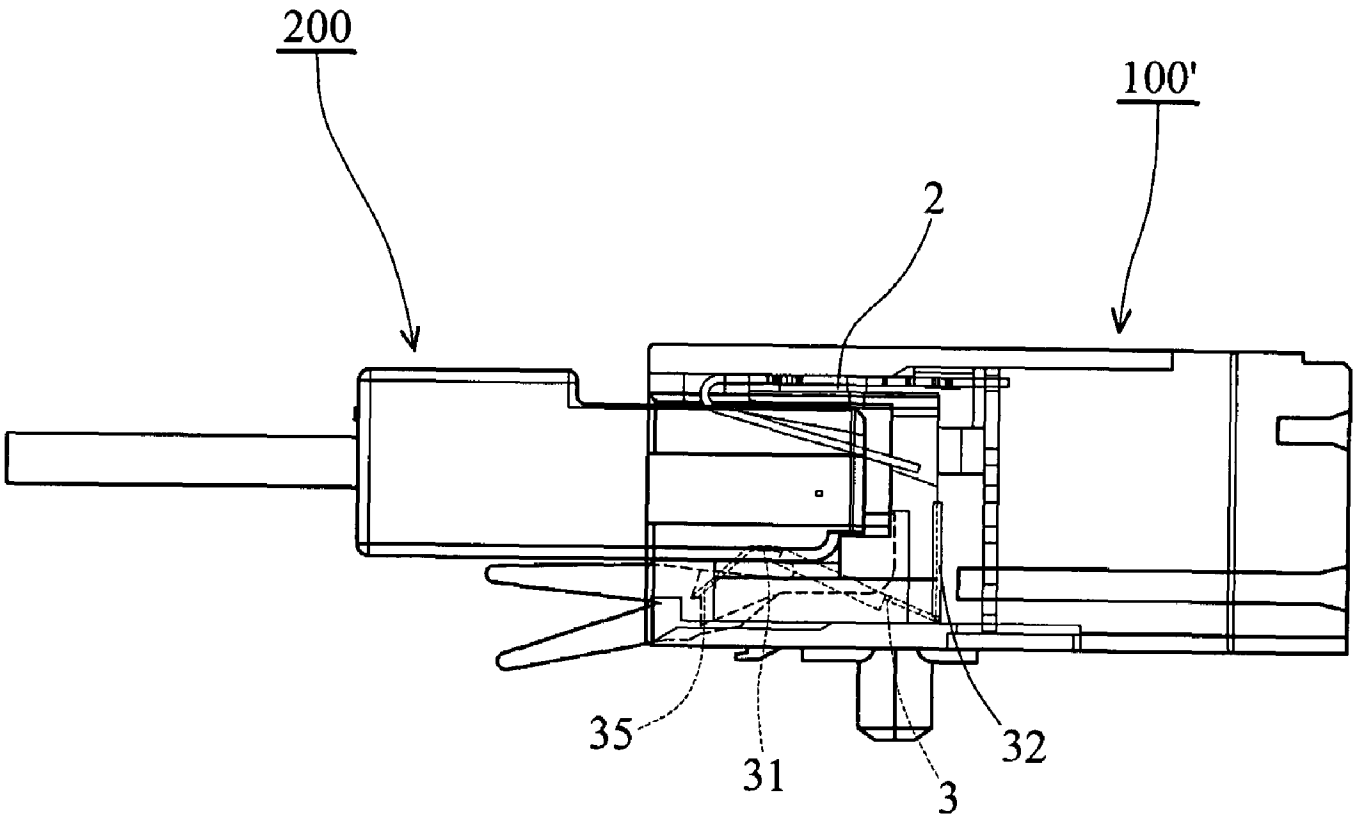
FIG. 2B is a schematic view of the connection module engaged with the external plug of FIG. 2A.

In FIG. 1A, a connection module 100 of the first embodiment of the invention is used for connecting an external plug 200 (as shown in FIGS. 2A and 2B) which has a plurality of external terminals therein. The connection module 100 comprises a body 1 having at least one slot 13 (shown in FIG. 1C), a plurality of internal terminals 2 and a holding device 3. The body 1 has an opening 11 and a hole 12. The opening 11 of the body 1 receives the external plug 200 corresponding to the body 1. The internal terminals 2 are disposed in the body 1 and electrically coupled to the external terminals of the external plug 200. The holding device 3 is also disposed in the body 1 and comprises at least one protrusion 31 for pressing against the external plug 200 when the external plug 200 is fitted in the opening 11.

Figure 1B:
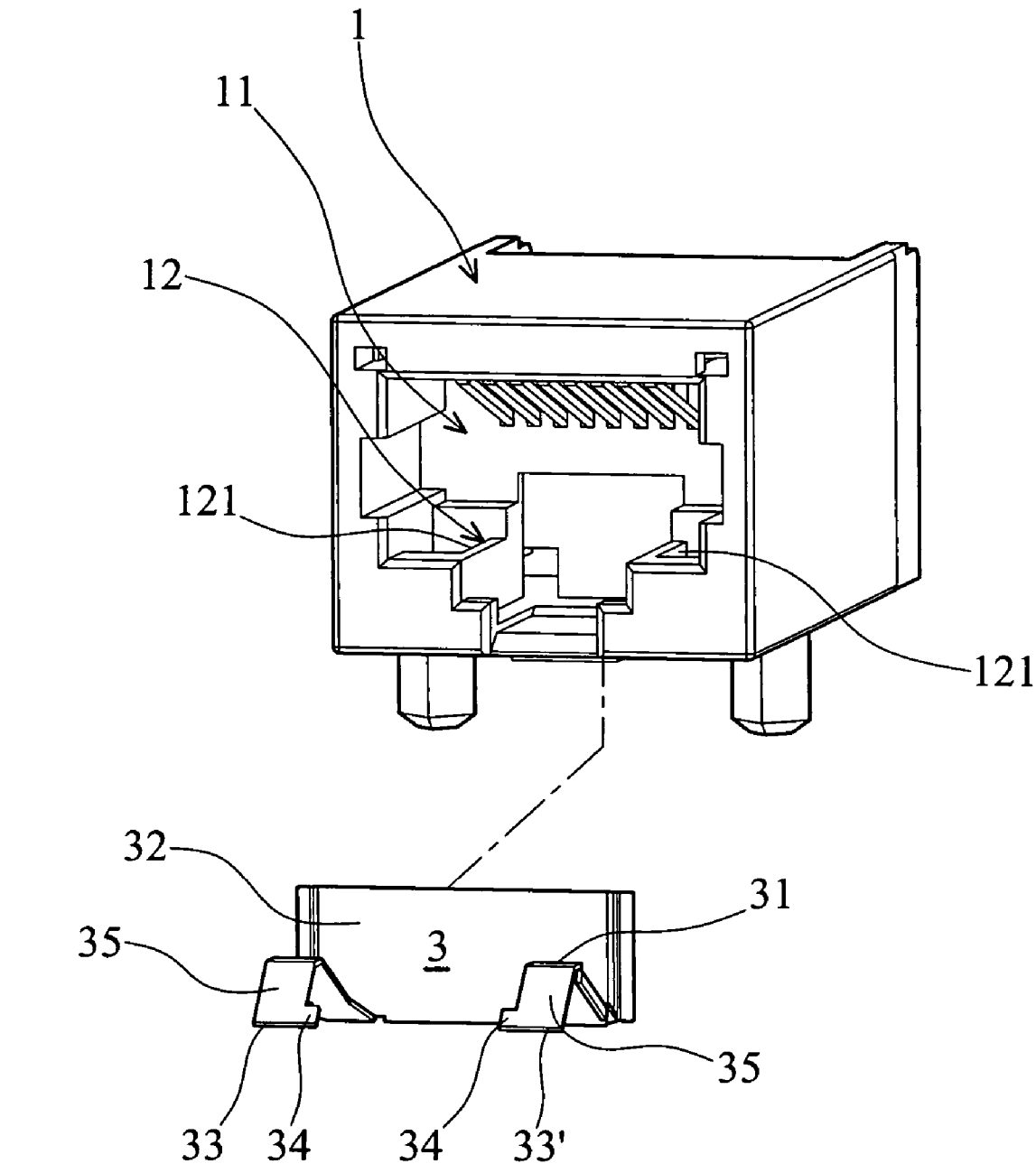
FIG. 1B is an exploded view of the connection module of FIG. 1A.

FIG. 1B is an exploded view of the connection module of FIG. 1A. The holding device 3 comprises a plate 32, a first support 33 and a second support 33'. The first and second support 33 and 33' are juxtaposed and respectively disposed in parallel at the opposite sides of the plate 32.

The first and second supports 33 and 33' respectively comprise at least one extended portion 34 and at least one slanted surface 35. The extended portions 34 of the first and second supports 33 and 33' abut against sidewalls 121 of the hole 12 to reinforce the structure of the first and second supports 33 and 33'. The slanted surfaces 35 of the first and second supports 33 and 33' serve to guide the external plug 200 into the body 1, and thus, the external plug 200 can be fitted to a correct position.

FIG. 1C is a sectional view of the connection module 100. The plate 32 is positioned at different levels from that of the first and second supports 33 and 33', and the plate 32 is engaged with the at least one slot 13 of the body 1. The first and second supports 33 and 33' pass through the hole 12.

In FIGS. 2A and 2B, a connection module 100' of the second embodiment of the invention differs from the first embodiment in that the hole is omitted and the holding device 3 is disposed in the opening 11.

In FIG. 2A, the protrusion 31 is projected to the opening 11 when the external plug 200 is not fitted in the opening 11. In FIG. 2B, the protrusion 31 pressing against the external plug 200 is located at the outside of the opening 11 in the body 1 when the external plug 200 is fitted in the opening 11. After the external plug 200 is moved from the opening 11, the protrusion 31 is again projected to the opening 11 (shown as FIG. 2A).

It is to be understood that the protrusion can be in various shapes to attain the object and function as mentioned above. The material of the holding device 3 is selected from a group consisting of plastic, metal, alloy, stainless or ceramic. Furthermore, the holding device 3 can be a resilient member. In this embodiment, the connection module 100 is an RJ-45 connector.

According to this invention, when one or more external plugs is or are respectively connected to the corresponding connection module, the individual external plug can be securely fixed on the corresponded connection module to prevent signal shorts therebetween, reduce signal interference and increase safety when using related electronic devices or equipment. Besides RJ-45 connectors, the connection module can be any kind of connector providing particular functions with computers or other communication equipment; thus, interference signal can be reduced.

While the invention has been described with respect to preferred embodiment, it is to be understood that the invention is not limited thereto, but, on the contrary, is intended to accommodate various modifications and equivalent arrangements included within the spirit and scope of the appended claims.

What is claimed is:

1. A connection module for connecting an external plug, comprising:

a body having an opening for receiving the external plug, and a hole;

a plurality of internal terminals disposed in the body for electrically coupling to the external plug; and a holding device engaged with the hole of the body and having a plate, at least one protrusion extending from the plate for pressing against the external plug when the external plug is fitted in the opening, at least one support extending from the at least one protrusion and having an extended portion abutting against sidewalls of the hole of the body.

2. The connection module as claimed in claim 1, wherein the body has a slot for engaging with the plate.

3. The connection module as claimed in claim 1, wherein the at least one support has a first support and a second support, and the plate is positioned at a different level from that of the first support and the second support.

4. The connection module as claimed in claim 3, wherein the first support and the second support are juxtaposed in parallel.

5. The connection module as claimed in claim 4, wherein the first support and the second support are disposed at opposite ends of the plate respectively.

6. The connection module as claimed in claim 3, wherein the first support and the second support respectively have at least one slanted surface.

7. The connection module as claimed in claim 3, wherein the first support and the second support respectively have at least one extended portion for abutting against the sidewall of the hole.

8. The connection module as claimed in claim 1, wherein the holding device is selected from a group consisting of plastic, metal, alloy, stainless or ceramic.

9. The connection module as claimed in claim 1, wherein the holding device has a resilient member.

10. The connection module as claimed in claim 1, wherein the connection module is an RJ-45 jack.

11. A connection module for connecting an external plug, comprising:

a body having an opening used for receiving the external plug;

a plurality of internal terminals disposed in the body for electrically coupling to the external plug; and a holding device disposed in the body and having a plate, at least one protrusion extending from the plate for pressing against the external plug when the external plug is fitted in the opening, at least one support extending from the protrusion and disposed in the opening of the body;

wherein the body has a slot for engaging with the plate, and the at least one support has a first support and a second support, both of which are disposed in parallel and at opposite ends of the plate respectively.

12. The connection module as claimed in claim 11, wherein the plate is positioned at a different level from that of the at least one support.

13. The connection module as claimed in claim 11, wherein the first support and the second support respectively have at least one slanted surface.

14. The connection module as claimed in claim 11, wherein the holding device is made of a material selected from a group consisting of plastic, metal, alloy, stainless or ceramic.

15. The connection module as claimed in claim 11, wherein the holding device is a resilient member.

16. The connection module as claimed in claim 11, wherein the connection module is an RJ-45 jack.

17. A connection module for connecting an external plug, comprising:

a body having an opening used for receiving the external plug;

a plurality of internal terminals disposed in the body for electrically coupling to the external plug; and a holding device disposed in the body and having a plate, at least one protrusion extending from the plate for pressing against the external plug when the external plug is fitted in the opening, at least one support extending from the protrusion and disposed in the opening of the body;

wherein the body has a slot for engaging with the plate, and the connection module is an RJ-45 jack.

* * * * *